United States Patent [19]

Holiday et al.

[11] 4,078,873

[45] Mar. 14, 1978

[54] APPARATUS FOR PRODUCING METAL POWDER

[75] Inventors: Paul R. Holiday, Palm Beach Gardens; Robert J. Patterson, Lake Park, both of Fla.

[73] Assignee: United Technologies Corporation, Hartford, Conn.

[21] Appl. No.: 751,004

[22] Filed: Dec. 15, 1976

Related U.S. Application Data

[62] Division of Ser. No. 654,247, Jan. 30, 1976.

[51] Int. Cl.[2] ..... B22D 23/08

[52] U.S. Cl. ..... 425/8; 264/8; 264/14; 264/82

[58] Field of Search ..... 425/8; 264/8, 14, 82

[56] References Cited

U.S. PATENT DOCUMENTS

| | | | |
|---|---|---|---|
| 2,439,776 | 4/1948 | Klein et al. | 425/8 |
| 2,699,576 | 1/1955 | Colbry et al. | 425/8 X |
| 2,931,422 | 4/1960 | Long | 425/8 X |
| 3,190,736 | 6/1965 | Benner | 425/8 X |
| 3,196,192 | 7/1965 | Vruggink et al. | 425/8 X |
| 3,266,085 | 8/1966 | Nacke | 425/8 |
| 3,285,722 | 11/1966 | Levecque et al. | 425/8 X |

FOREIGN PATENT DOCUMENTS

| | | | |
|---|---|---|---|
| 296,626 | 8/1963 | Netherlands | 425/8 |

*Primary Examiner*—Robert L. Spicer, Jr.
*Attorney, Agent, or Firm*—Jack N. McCarthy

[57] ABSTRACT

An apparatus is set forth wherein powder is produced by melting metal in a melting furnace where it is then poured into a tundish which directs the molten metal onto a spinning disc means. The tundish is located at the center of a nozzle plate which contains a plurality of annular nozzle means for directing a coolant flow downwardly around the spinning disc means at different radial positions. Controls are provided for controlling atmosphere in said apparatus. Further, controls are provided to control the speed of the disc means and the mass flow of the cooling fluid through each of the nozzle means.

11 Claims, 3 Drawing Figures

APPARATUS FOR PRODUCING METAL POWDER

This is a division of application Ser. No. 654,247, filed Jan. 30, 1976.

CROSS-REFERENCE TO RELATED APPLICATION

Application Ser. No. 653,693, filed herewith, to Jerry A. King for Apparatus for Making Metal Powder discloses a similar arrangement.

BACKGROUND OF THE INVENTION

This invention relates to the formation of metal powders which are cooled at high rates.

Metal powders, or particulate matter, have been previously formed in the prior art and representative patents disclosing various means and methods are set forth below:

U.S. Pat. No. 1,351,865; U.S. Pat. No. 2,304,130: U.S. Pat. No. 2,310,590; U.S. Pat. No. 2,630,623; U.S. Pat. No. 2,956,304; U.S. Pat. No. 3,510,546; U.S. Pat. No. 3,646,177; U.S. Pat. No. 3,695,795 and U.S. Pat. No. 3,771,929

SUMMARY OF THE INVENTION

According to the present invention, an apparatus is set forth which will produce a large quantity of metal powder which is cooled at a very high controlled rate.

It is an object of this invention to provide an apparatus in which molten metal is poured on a spinning disc and flung off into a flowing annular curtain of coolant which is directed from a plurality of nozzles downwardly; said molten metal being flung outwardly in a horizontal plane from the disc into the coolant which is directed downwardly.

It is another object of this invention to provide a cooling gas injection arrangement whereby a plurality of gas jets are placed around the spinning disc at spaced radial distances, each of said gas jets extending around said disc providing substantially an annular-like jet.

It is a further object of this invention to provide different mass flows of cooling fluid from each of the plurality of the nozzles, providing a control of the cooling rate of the particles of the molten metal projected into the plurality of cooling fluid jet areas.

It is also a further object of this invention to control the spinning rate of the disc along with cooling flow which provides control of the powder size and cooling rate.

It is another object of the invention wherein all parameters which determine a particulate cooling rate are capable of being controlled.

It is a further object of this invention to provide a method whereby the radial mass flux flow profile of the radially located cooling gas jets is approximately matched to the heat flux given off by the particles projected outwardly into the cooling gas jets so as to achieve a practical maximum $\Delta T$ between the cooling gas and the particles using the least amount of cooling gas possible. This method can be used to obtain cooling rates of particles of 50 microns in the range of $10^{5}$° C/sec and greater.

DESCRIPTION OF THE PREFERRED EMBODIMENT

Figure 1A:
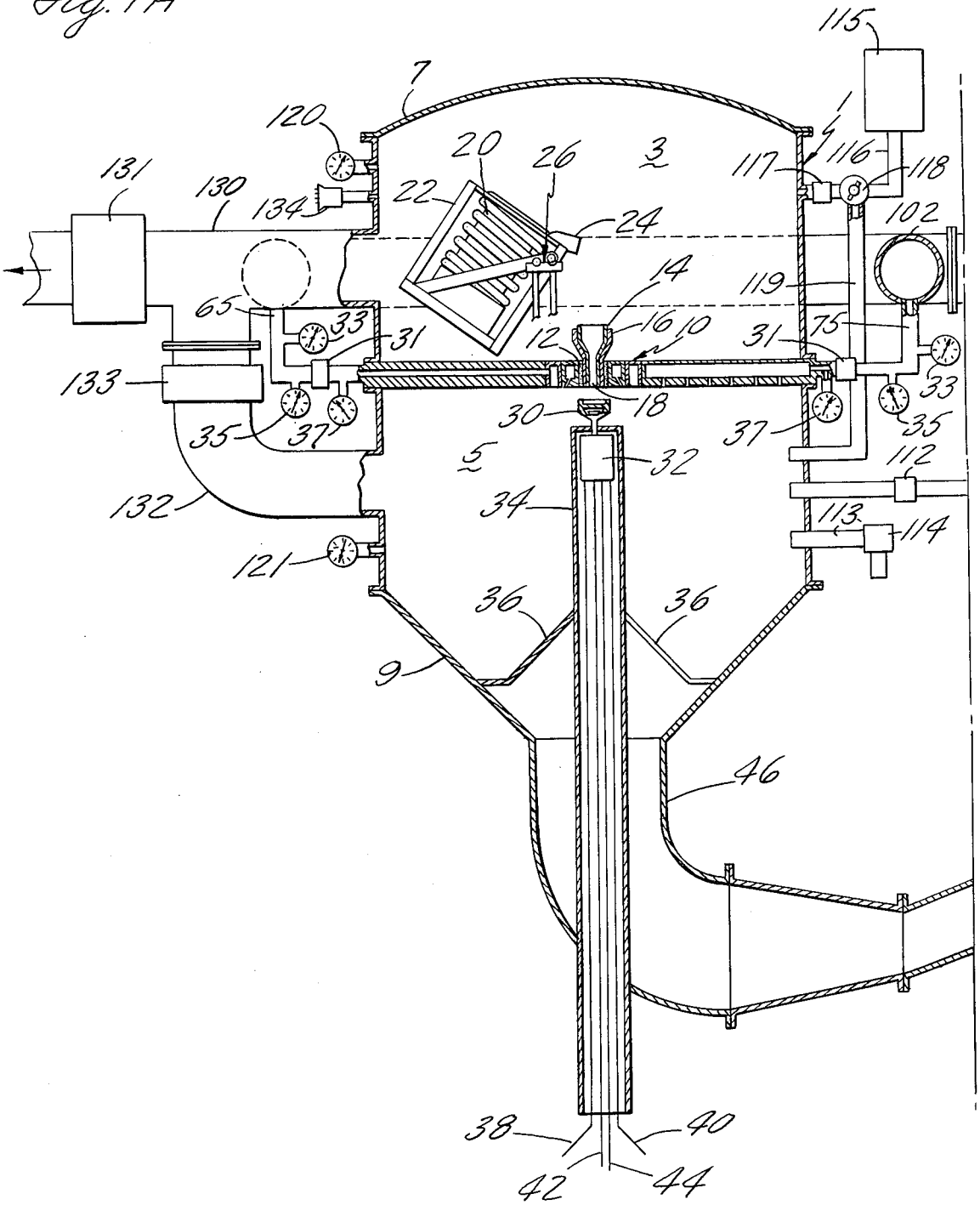
FIG. 1A and 1B is a schematic showing of the apparatus for making metal powder.
Figure 1B:
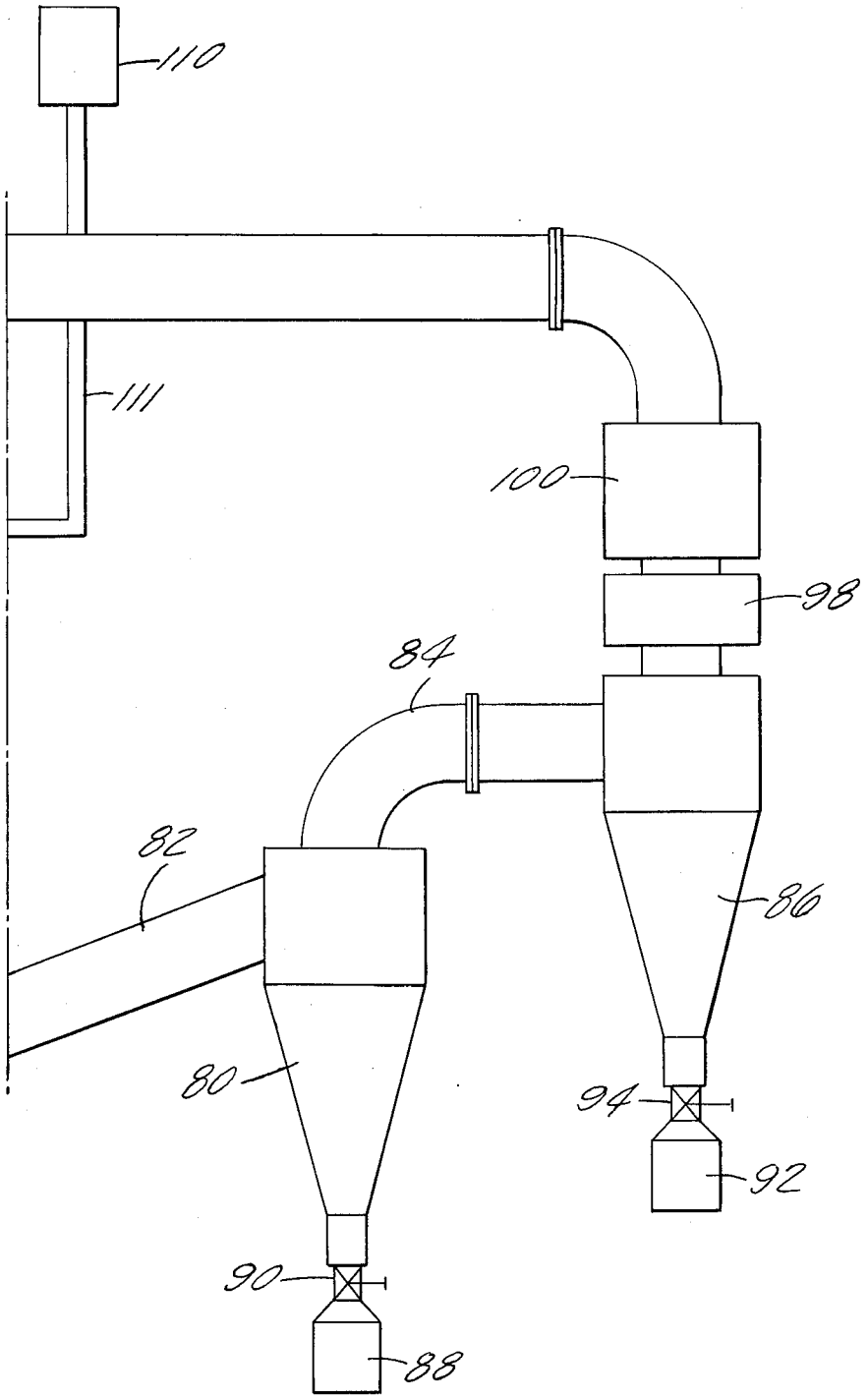

The apparatus shown in FIG. 1 consists of a cylindrical housing 1 having an upper chamber 3 and lower chamber 5 separated by a nozzle plate means 10. The nozzle plate means 10 has a central opening 12 for supporting a tundish 14 with a preheating furnace 16 mounted therearound. Insulating means are positioned between the furnace 16 and nozzle plate means 10.

The preheating furnace 16 can be of many types with the controls mounted externally of the housing 1. The cylindrical housing 1 has an upper and lower cylindrical section, with the lower edge of the upper section around chamber 3 being fixed to the top of the nozzle plate means 10, while the upper edge of the lower section around chamber 5 being fixed to the bottom of the nozzle plate means 10. A cover 7 is removably fixed to the upper edge of the upper section of the cylindrical housing 1 and a funnel-shaped member 9 is connected to the lower edge of the lower section of the cylindrical housing 1 for a purpose to be hereinafter described. The tundish 14 has a nozzle, or restricted opening, 18 which forms a passage between the chambers 3 and 5 at all times; however, as hereinafter described, during operation is filled with liquid metal, thereby isolating the two chambers, 3 and 5, completely.

A crucible 20, having an induction furnace associated therewith, is mounted in a supporting frame means 22. The supporting frame means 22 can be moved between the position shown in FIG. 1 and a position where it has been rotated to a position permitting molten metals in the crucible 20 to pour from a spout 24 into the tundish 14. A double trunnion pin arrangement 26 is shown to maintain the poured molten metal as close to the center of the tundish 14 as possible to prevent unnecessary spilling thereof. As the supporting frame means 22 is tilted from the position shown in FIG. 1 to a pouring position, it can be seen that the tilting axis will change from the one trunnion to the other at one point in the tilting of the crucible 20, which will alter the pivotal movement of the spout 24. This type of arrangement is well known in the art. The supporting frame means 22 can be rotated by any known means desired. A drum and cable assembly is shown in the corresponding application Ser. No. 653,693.

A rotating disc, or atomizer rotor, 30 is mounted for rotation in the lower chamber 5 below the tundish 14 with the center of the disc being positioned under the nozzle 18. The rotating disc, or atomizer rotor, 30, is rotated by an air turbine device 32 which is fixed to an upstanding cylindrical pedestal 34 fixedly positioned in the lower chamber 5 by a plurality of supporting struts 36. The rotating disc, or atomizer rotor, 30 is formed having cooling passages therein with cooling water being passed therethrough by an inlet pipe 38 and outlet pipe 40. Air for driving the air turbine device 32 is directed thereto through conduit 42 and is directed away therefrom through conduit 44. The rotating disc, or atomizer rotor, 30, has a contoured surface for receiving the molten metal and is rotated at a rate of speed commensurate with the desired particle size distribution. While an air turbine has been referred to, any known driving means can be used.

The nozzle plate means 10, while supporting the tundish 14 and furnace 16, separates the upper chamber 3 and lower chamber 5 by a solid upper surface while its lower surface is formed having a plurality of nozzle means 50, 60 and 70 which provide separate regions of cooling gas jets extending downwardly from the nozzle plate means 10 located at different radial locations from the center of the nozzle 18, or rotating disc, or atomizer rotor, 30. While three nozzle means have been shown, a greater number can be used for more varied control for a given radius of a cylindrical housing 1.

It can be seen that the metal particles formed by the rotating disc, or atomizer rotor, 30 are released from the rim thereof in an outwardly direction and project outwardly into the annular region of the cooling gas jets extending downwardly from the nozzles 50, 60 and 70 of the nozzle plate means 10. These particles are deflected by the cooling gas jets in the nozzle plate means 10 and are carried by the cooling gas into the funnel-shaped member 9. The funnel-shaped member 9 is connected to a central exhaust conduit 46 which is in turn connected to a first particle size discriminating separator 80 by a connecting pipe 82. This separator removes particles larger than a given size and passes all other particles through connecting pipe 84 into the second size discriminating separator 86 which effectively removes all of the remaining particles from the cooling gas stream.

Separator 80 deposits the particles removed thereby in a powder container 88 which can be sealed off by an on-off valve 90 and both valve and container removed from the apparatus for purposes of powder transportation. In a similar manner, separator 86 deposits the particles removed thereby in a powder container 92 which can be sealed off by an on-off valve 94 and both valve and container removed from the apparatus for purposes of powder transportation. Other powder containers and valves can be connected for the next operation of the apparatus. The larger sized powder particles removed by separator 80 and deposited in container 88 will all have cooled slower than the particles removed by the separator 86, as under steady state operating conditions, the individual particle cooling rate is a function only of particle size. The number of particle size discriminating separators need not be limited to two, but other numbers can be used to separate the particles in a desired number of particle size ranges and hence, a multiplicity of cooling rate ranges.

A heat exchanger 98 removes from the cooling gas stream that thermal energy transferred to the gas by the hot particles, such that the inlet temperature to a cooling gas compressor circulating pump 100 is 30° to 40° C under normal operating conditions. The circulating pump 100 boosts the cooling gas pressure to its desired operating pressure with this compressed gas being fed to a supply manifold 102. Subsequent metering to the three nozzle means 50, 60 and 70 will be hereinafter discussed. Additional heat exchangers may be inserted in the line between the compressor circulating pump 100 and the supply manifold 102 to further reduce the cooling gas temperature before admitting it to the nozzle plate means 10.

Figure 2:
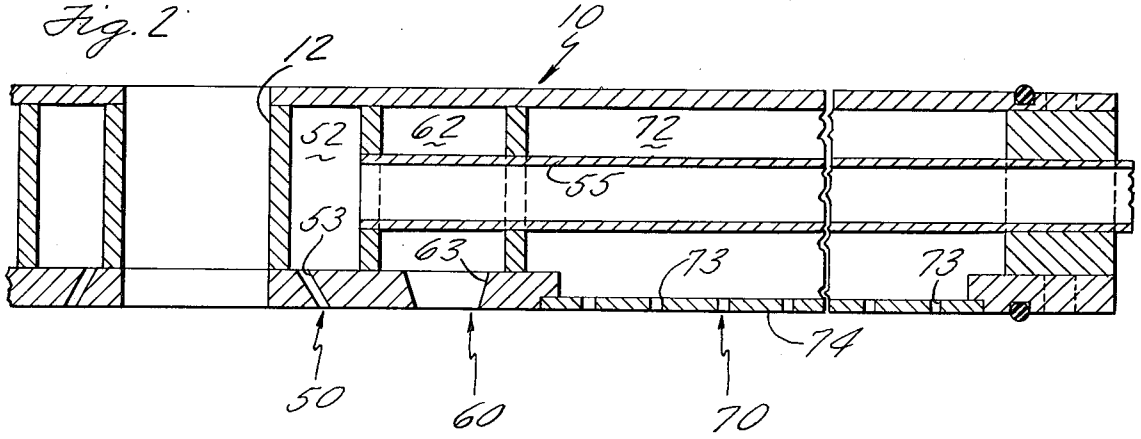
FIG. 2 is an enlarged view of the nozzle plate means showing the location of the annular manifolds.

While the nozzle plate means 10 is schematically shown in FIG. 1, one means of construction is shown in FIG. 2. FIG. 2, as FIG. 1, comprises three annular manifolds 52, 62 and 72, with the total assembly being brazed together. An annular nozzle opening 53 is provided for nozzle means 50, annular opening 63 is provided for nozzle means 60, and a plurality of openings 73 are provided for a larger part of the radial distance of the cylindrical housing 1, with these openings being spaced throughout the annular surface of the plate 74 forming the lower surface of the nozzle means 70. Each annular manifold 52, 62 and 72 is connected to the supply manifold 102 by a conduit means. The inner annular manifold 52 is connectd to supply manifold 102 by a conduit 55. Outer annular manifold 72 is connected to supply manifold 102 by a conduit 75. Intermediate annular manifold 62 is connected to supply manifold 102 by a conduit 65. To control the flow rate of cooling gas through the individual annular manifolds 52, 62 and 72 of the nozzle plate means 10, a multiplicity of flow control valves are used, one in each of the conduits 55, 65 and 75 located between the supply manifold 102 and annular manifolds 52, 62 and 72.

A flow control valve 31 is located in each of the conduits 55, 65 and 75 to control the flow rate of cooling gas through the annular manifolds 52, 62 and 72 connected to the nozzle means 50, 60 and 70. Valves 31 can be controlled by any known means desired. Upstream temperature and pressure gages 33 and 35, together with a downstream pressure gage 37, are used to monitor the flow through each of the flow control valves 31, such valves having previously been calibrated on a flow bench. The flow control will permit an operator to achieve the desired flow through each of the nozzle means 50, 60 and 70 at their different radial positions.

A supply of a coolant gas from a supply 110 is connected to the lower chamber 5 by conduit 111 and valve means 112. A venting means is connected to the lower chamber 5 having a conduit 113 and valve means 114. In the event that it is desired to backfill the upper chamber 3 with an inert (such as helium or argon) or some other desirable gas, other than the coolant gas, a second gas supply 115 is connected to the upper chamber 3 by conduit 116 and valve means 117. The conduit 116 contains a control regulator 118 which is connected to the lower chamber 5 by a conduit 119. When a gas is used from gas supply 115 the control regulator 118 senses the pressure in lower chamber 5 and admits or vents gas from upper chamber 3 to maintain the $\Delta$ P between the chambers 3 and 5 at a desired level. Pressure gages 120 and 121 are provided to monitor the pressure in the upper chamber 3 and lower chamber 5, respectively.

A vacuum producing means is connected to upper chamber 3 by a conduit 130 having an on-off valve 131 therein. Conduit 130 is connected between valve 131 and upper chamber 3 by a conduit 132 to lower chamber 5. An on-off valve 133 is located in conduit 132 to isolate upper chamber 3 from lower chamber 5. A vacuum gage 134 is connected to upper chamber 3 to determine the vacuum pressure in the chamber.

A typical operating cycle of the apparatus would consist of the following operations: The cover 7 would be removed to allow charging of the crucible 20, and where removable tundishes are used, an insertion of the properly sized tundish 14, and nozzle 18. After the cover 7 is replaced, valve means 112, 117 and 114 are closed and the vacuum producing means started before opening valve 133 and valve 131, in that order. The interior of the entire apparatus is then evacuated, including powder containers 88 and 92 through open valves 90 and 94, respectively. When a pressure of less than $1 \times 10^{-3}$ mm Hg has been reached in the upper chamber 3, valve 131 is closed, and the pressure rise in the system checked by means of vacuum gage 134, to determine if there are any chamber leaks, or extraordinary outgassing taking place.

Valve 131 is then reopened and power applied to preheating furnace 16 and the induction furnace associated with crucible 20. When the two furnaces have been brought to their desired temperatures, the crucible 20 is ready to have the molten metal therein poured into the tundish 14.

At this point there are two possible modes of operation: (1) upper chamber 3 and lower chamber 5 and connected components can be backfilled with the same cooling gas or (2) upper chamber 3 can be backfilled with an inert, or other desirable gas, while lower chamber 5 and connected components can be backfilled with a different cooling gas.

In the first mode of operation, valve 131 is closed and valve 112 is opened, with the desired gas passing from gas supply 110 into upper chamber 3 and into lower chamber 5 and connected components through open valve 133. The backfilling is continued until a slight positive pressure exists in the system (approximately 1 psig), this can be monitored by gage 121.

In the second mode of operation, valves 131 and 133 are closed and valve 117 is opened, the flow therethrough being controlled by the control regulator 118, the control signal being the pressure in lower chamber 5. Valve 112 is then opened admitting the desired cooling gas to lower chamber 5. When the pressure in upper chamber 3 and lower chamber 5 reaches the desired level as indicated by gages 120 and 121, valve 112 is closed and the recirculating compressor 100 is started. This will cause changes in pressure in lower chamber 5, said pressure change being signaled to control regulator 118 to make a pressure change in upper chamber 3, thereby maintaining the desired $\Delta$ P between the upper chamber 3 and lower chamber 5. During operation of the apparatus the proper amount of cooling fluid desired in the closed system can be maintained by proper use of the valves 112 and 114.

Temperature gages 33 and pressure gages 35 and 37 are checked to insure that the flow through the annular manifolds 52, 62 and 72 and nozzle openings of the nozzle means 50, 60 and 70 is as desired. Flow control valves 31 are readjusted as necessary to achieve the desired flow conditions. The rotating disc, or atomizer rotor, 30, is brought up to the desired rpm at which particles of desired sizes are obtained. Cooling water is applied to the cooling passages in the atomizer rotor 30 through inlet pipe 38 and removed by outlet pipe 40.

The supporting frame means 22 is tilted and liquid metal is poured from the crucible 20 into the preheated tundish 14 and maintained at a desired level in the tundish by an operator. The pressure head of liquid metal in the tundish 14, the area of the nozzle, or restricted opening, 18, and the pressure differential between the upper chamber 3 and lower chamber 5 can be changed to obtain the desired flow rate of liquid metal through the nozzle 18. The liquid metal flows through the tundish nozzle 18 and onto the rotating disc, or atomizer rotor, 30. The surface onto which the liquid metal flows imparts kinetic energy to the liquid metal, this metal ultimately being flung from the edge of the rotor in the form of droplets, ligaments, or sheets, depending on the rpm of the rotating disc, or atomizer rotor, 30, the flow rate of the liquid metal through the nozzle 18, and the fluid properties of the liquid metal. Regardless of the geometric form of the liquid metal flung outwardly, it is ultimately broken into spherical droplets by the combined action of inertial, viscous and surface forces, such droplets being force convectively cooled by the action of their contact with the annular curtain of cooling fluid directed downwardly from the nozzle plate means 10. The powder particles are carried from lower chamber 5 by action of the cooling gas stream, as previously described, and deposited in containers 88 and 92, depending on particle size.

When the crucible 20 is empty, it is tilted back to an upright position with the air turbine device 32 being deactivated as well as the flow of cooling water through annular pipe 38. The furnaces are turned off along with the recirculating compressor 100. Valves 90 and 94 are closed and valve 133 is opened if different gases have been used in upper chamber 3 and lower chamber 5, otherwise it is already open, and vent valve 114 is opened to allow the system pressure to bleed down to atmospheric pressure. The powder product is now contained in containers 88 and 92 which allows the container and valve assembly to be removed from the apparatus and transported under completely inert conditions.

While it can be seen that many predetermined gas flows can be preset to exit from each of the nozzle means 50, 60 and 70, in a device constructed, a total mass flow from supply manifold 102 was set at 2 lb/sec with the mass flows from each of the nozzle means 50, 60 and 70 divided so that the gas mass flux flow profile was matched to the radial profile of heat flux given off by the particles to the gas flow. While this gas flux profile is stepped, it maintains a practical maximum particle-to-gas $\Delta$ T at all radial locations and is a most efficient use of the cooling gas flow. Further, in the device constructed, a pressure head of 4 inches (10.16 cm) and a nozzle diameter of 5/32 of an inch (0.397 cm) was used to deliver a molten alloy at a mass flow rate of 0.338 lb/sec. A speed of 18,000 rpm has been used with an atomizer rotor 30 contoured as a cup having a 3.25 inch (8.225 cm) inner diameter to produce metal particles in a range including 10 microns in diameter to 50 microns in diameter. With the radial mass flux flow profile of the cooling gas nozzle means being approximately matched to the radial profile of the heat flux given off by the particles to the gas, mean cooling rates can be obtained in a range of $10^{50}$ C/sec and greater. The specific mean cooling rates achieved depend upon the particle size, the thermal properties of the alloy, the thermal properties of the gas, the alloy temperature range of interest, and the relative velocity of the particle and gas. To readily obtain these cooling rates with particle sizes up to 75 microns, it is necessary that a high thermal conductivity gas, such as hydrogen or helium, be used.

The three nozzle flows exiting from cooling gas nozzle means 50, 60 and 70, whether of the same or different gas types, may be at different temperatures to exert further control over the particle cooling rate at specific radial locations in chamber 5. One means of achieving this would be to install a gas heater or cooler in each of the annular manifolds 52, 62 and 72.

It is noted that separate cooling fluid systems and controls and controls can be used for each of the manifolds 52, 62 and 72 so that different cooling fluids can be directed from any of the nozzle means 50, 60 and 70. When this is done the mixed gas exhaust from the particle separators is diverted to atmosphere or to a collecting device for subsequent separation of the gases for reuse. One or more of the cooling gases can be chemically reactive with the metal particles to achieve a desired chemical composition, or phase morphology, on the surface of the particle.

Where the terms "match" and "coordinated" are used relating to controlling the mass flux of the cooling gas jets to the heat flux given off by the particles projected into the cooling gas jets, the "matching" and "coordinating" is accomplished by maximizing the product of the deterministic heat transfer parameters along the path of the particles as they traverse adjacent curtains of cooling fluid.

We claim:

1. An apparatus for producing metal particles including means for melting metal, a disc means mounted for rotation, means for pouring molten metal on said disc means, means for projecting a moving annular curtain of cooling fluid downwardly around said disc means, means for rotating said disc means for flinging said molten metal into said annular curtain of cooling fluid for forming metal particles, means below said disc means for collecting cooled metal particles, said means for projecting a moving annular curtain of cooling fluid downwardly around said disc means comprising an annular nozzle means having a plurality of annular nozzles positioned above said disc means, each annular nozzle being positioned for projecting annular section of said moving annular curtain of cooling fluid, said plurality of annular sections forming said moving annular curtain, each annular nozzle having an individual control for directing a desired mass flow rate of cooling fluid therethrough to form its annular section and obtain a high cooling rate of molten metal flung into said annular curtain of cooling fluid.

2. An apparatus as set forth in claim 1 wherein said individual controls direct different mass flow rates of cooling fluid through said annular nozzles for obtaining the highest cooling rate of the molten metal flung into said annular curtain of cooling fluid for the total mass flow rate of cooling fluid passing through said annular nozzles.

3. An apparatus as set forth in claim 2 wherein the flow rates of cooling fluid are decreased from the inner annular nozzle to the outer annular nozzle.

4. An apparatus as set forth in claim 1 having a housing with an upper and lower chamber, said means for melting metal being located in said upper chamber, said disc means being mounted for rotation in said lower chamber, plate means separating said two chambers, means being positioned in said plate means for receiving molten metal from said means for melting metal and directing molten metal on said disc means.

5. An apparatus as set forth in claim 4 including vacuum producing means for evacuating the interior of the upper and lower chambers, and backfilling means for backfilling the upper and lower chambers with a gas.

6. An apparatus as set forth in claim 4 including means for directing an inert gas into said upper chamber, and means for directing a cooling gas into said lower chamber.

7. An apparatus as set forth in claim 6 including means for maintaining a desired pressure differential between the inert gas in said upper chamber and the cooling gas in said lower chamber.

8. An apparatus as set forth in claim 4 wherein said plate means contains a plurality of annular manifolds therein, each manifold having an annular nozzle means for directing flow therefrom downwardly.

9. An apparatus as set forth in claim 4 wherein said lower chamber has a cylindrical wall around said disc means, said disc means having an outer edge, said nozzles being located adjacent each other for directing an annular curtain of cooling fluid from adjacent the outer edge of said disc means to adjacent said cylindrical wall.

10. An apparatus as set forth in claim 1 wherein said disc means has an outer edge, one of said annular nozzles being positioned for directing an annular section of cooling fluid downwardly adjacent the outer edge of the disc means, the other of said plurality of annular nozzles being located radially outwardly from said one annular nozzle, said plurality of annular nozzles being positioned adjacent each other.

11. An apparatus as set forth in claim 1 wherein said plurality of annular nozzles comprises three annular nozzles, said disc means having an outer edge, one of said annular nozzles being positioned for directing a first annular section of cooling fluid downwardly adjacent the outer edge of the disc means, the second of said annular nozzles being positioned for directing a second annular section of cooling fluid downwardly adjacent said first annular section of cooling fluid, said third annular nozzle being positioned for directing a third annular section of cooling fluid downwardly adjacent said second annular section of cooling fluid, said first, second, and third annular sections forming said moving annular curtain.

* * * * *

UNITED STATES PATENT OFFICE

CERTIFICATE OF CORRECTION

PATENT NO. : 4,078,873

DATED : March 14, 1978

INVENTOR(S) : PAUL R. HOLIDAY and ROBERT J. PATTERSON

It is certified that error appears in the above-identified patent and that said Letters Patent are hereby corrected as shown below:

Column 6, line 37: after "inch" change "(8.225 cm)" to read -- (8.255 cm) --.

Column 6, line 44: change "$10^{50}$" to read -- $10^{5°}$ --.

Column 6, line 61: after "controls" delete "and controls".

Signed and Sealed this

*Fifth* Day of *September 1978*

[SEAL]

*Attest:*

RUTH C. MASON
*Attesting Officer*

DONALD W. BANNER
*Commissioner of Patents and Trademarks*